US009050710B2

(12) United States Patent
Jones et al.

(10) Patent No.: US 9,050,710 B2
(45) Date of Patent: Jun. 9, 2015

(54) WOODWORKING VISES

(75) Inventors: Steven K. Jones, Ottawa (CA); Brent K. Hyde, Ottawa (CA); Brian Ebbinghaus, Ottawa (CA); Paul Roach, Ottawa (CA)

(73) Assignee: Lee Valley Tools Ltd., Ottawa, Ontario (CA)

( * ) Notice: Subject to any disclaimer, the term of this patent is extended or adjusted under 35 U.S.C. 154(b) by 1015 days.

(21) Appl. No.: 13/171,533

(22) Filed: Jun. 29, 2011

(65) Prior Publication Data

US 2011/0316212 A1 Dec. 29, 2011

Related U.S. Application Data

(60) Provisional application No. 61/359,468, filed on Jun. 29, 2010, provisional application No. 61/387,716, filed on Sep. 29, 2010.

(51) Int. Cl.

| | |
|---|---|
| ***B25B 1/02*** | (2006.01) |
| ***B25B 1/12*** | (2006.01) |
| ***B25B 1/10*** | (2006.01) |

(52) U.S. Cl.

CPC ..... *B25B 1/125* (2013.01); *B25B 1/103* (2013.01)

(58) Field of Classification Search

USPC ..... 269/181, 43, 45, 95, 71, 76

See application file for complete search history.

(56) References Cited

U.S. PATENT DOCUMENTS

| | | | |
|---|---|---|---|
| 3,212 | A | 8/1843 | Matthews |
| 177,090 | A | 5/1876 | Brundage |
| 293,058 | A | 2/1884 | Moore |
| 326,138 | A | 9/1885 | Moore |
| 467,781 | A | 1/1892 | Palm et al. |
| 493,364 | A | 3/1893 | Lewis |
| 515,986 | A | 3/1894 | Barnard |
| 651,929 | A | 6/1900 | Olson |
| 663,145 | A | 12/1900 | Zwart |
| 742,647 | A | 10/1903 | Herriman |
| 816,508 | A | 3/1906 | Snow |
| 825,151 | A | 7/1906 | McLean |
| 917,243 | A | 4/1909 | Boyle |
| 921,296 | A | 5/1909 | Smith |
| 985,857 | A | 3/1911 | Thomas |

(Continued)

FOREIGN PATENT DOCUMENTS

| | | |
|---|---|---|
| BE | 505411 | 9/1951 |

OTHER PUBLICATIONS

Lee Valley Tools Ltd. catalog, 1990/1991, pp. 72-73.

(Continued)

*Primary Examiner* — Lee D Wilson
*Assistant Examiner* — Nirvana Deonauth
(74) *Attorney, Agent, or Firm* — John S. Pratt; Megan E. Bussey; Kilpatrick Townsend & Stockton LLP

(57) ABSTRACT

Vises utilizing a threaded screw and nut to translate rotary motion of the screw into linear relative movement of vise components. The nut may be a half-nut urged into contact with the screw by a cam that may be operated by a lever located near the handle for turning the screw. A tail vise embodiment may be mounted to the underside of a workbench without signification bench modification and positions the screw near the front edge of the bench top. A front vise embodiment may include a screw cover to protect workpieces from contact with the screw.

9 Claims, 14 Drawing Sheets

(56) References Cited

U.S. PATENT DOCUMENTS

| | | | | | |
|---|---|---|---|---|---|
| 1,055,278 | A | | 3/1913 | Hunt | |
| 1,392,434 | A | | 10/1921 | Miller | |
| 1,509,509 | A | | 9/1924 | Gustafson | |
| 2,331,831 | A | | 10/1943 | Gordan | |
| 3,208,744 | A | | 9/1965 | Slifer | |
| 4,492,370 | A | * | 1/1985 | Park | 269/182 |
| 4,809,962 | A | * | 3/1989 | Lee | 269/182 |
| 4,858,902 | A | | 8/1989 | Hickman | |
| 4,953,839 | A | | 9/1990 | Chern | |
| 5,048,653 | A | | 9/1991 | Fellows | |
| 5,127,639 | A | | 7/1992 | Tucker et al. | |
| 5,301,934 | A | | 4/1994 | Lynn et al. | |
| 7,673,861 | B2 | * | 3/2010 | Meholovitch et al. | 269/181 |
| 2009/0283951 | A1 | * | 11/2009 | Rowley | 269/252 |

OTHER PUBLICATIONS

Woodworker's Supply of New Mexico catalog, Dec. 1989, pp. 24, 26 and 33.

Landis, Scott, The Workbench Book, The Tauton Press, p. 133, 1987.

Landis, Scott, The Workbench Book, The Tauton Press, Chapter 10, pp. 136-149, 1987.

* cited by examiner

WOODWORKING VISES

RELATED PATENT APPLICATIONS

This application claims priority to U.S. Provisional Application No. 61/359,468 entitled "Woodworking Vise", filed Jun. 29, 2010, and U.S. Provisional Application No. 61/387,716 entitled "Woodworking Vises", filed Sep. 29, 2010, both of which are incorporated herein by reference.

FIELD OF THE INVENTION

This invention relates to workbench vises, particularly including woodworking bench vises having wooden jaws.

BACKGROUND OF THE INVENTION

Workbenches are used to support and often secure work pieces in a desired orientation. Vises, hold-downs and other structures are often incorporated in or attached to workbenches to facilitate securing work pieces. Such woodworking benches utilized in the west often include two vises for holding work pieces, a "front vise" with vise jaw faces parallel to the front of the workbench and a "tail vise" with vise jaw faces perpendicular to the front of the workbench. Right handed woodworkers typically find the front vise most usefully located at the left end of the bench and the tail vise most usefully located at the right end.

Whether located at the right or left end of the bench, the tail vise is generally used for clamping long panels, boards or other work pieces against bench dogs or other stops, one or more of which is located in the top of the bench and the other of which is in the vise jaw. Alternatively, dogs or stops may be positioned on the front apron of the bench and the front of the vise jaw. Work pieces or jigs or other objects can also be captured between an end of the tail vise jaw and an end of the bench apron, which serves as the stationary one of the two vise jaws.

Also without regard to location at the right or left end of the bench, a front vise is generally used for clamping boards of various lengths, and shapes between a front vise jaw and a rear jaw or the front edge of the bench, which often serves as, or is part of, the front rear jaw of such vises. Like the tail vise, the movable jaw of a front vise can carry one or more bench dogs that are used with one or more bench dogs positioned in the top of the bench behind the front vise.

Rotation of vise screws move the movable vise jaw relatively slowly in order to provide significant mechanical advantage. As a result, many vises and vise mechanisms have "quick release" functionality to permit the movable jaw to be slid quickly open or closed to a position in contact with work piece. Known such mechanisms permit the vise jaws to apply significant closing pressure. However, vises that permit the jaws to be opened or separated with the screw mechanism applying significant force are useful in certain clamping and component separation processes.

Typically, the screw mechanisms for tail vises are built into the jaw, requiring substantial woodworking skill and effort to install and align. Often, the overall design of a bench must be modified to accommodate these mechanisms, and retro-fitting a tail vise mechanism to an existing bench can be very difficult.

Front vises generally have a movable jaw parallel to the front edge of the bench that moves perpendicular to that front edge. In some such vises the front jaw is sometimes supported by rods that pass from the bench into the lower portion of the front jaw. In other such vises, sometimes called "leg" vises.

the front jaw component extends from the top of the bench almost to the floor parallel to one of the bench front legs. A large screw, often made of wood, typically passes through the front jaw and is threaded into the adjacent bench leg or another threaded, stationary member. Rotation of the screw in one direction releases the jaw and rotation in the other direction tightens it. Such "leg vise" front jaws are supported by the screw and, typically, a generally horizontal member that extends from the lower end of the jaw into an opening in the leg. A transverse pin through an appropriate one of a series of holes in the horizontal member counter-balances the force exerted by closing the screw in order to apply force with the upper end of the vise jaw that is pressed in the direction of the front of the bench.

Yet another type of front or "shoulder" vise on woodworking benches is sometimes referred to as a "Scandinavian-style" vise. It utilizes a screw that moves through a threaded member that is part of or attached to an arm that is mounted to project from a support attached to the front of the bench so that the arm projects parallel to but spaced several inches away from the front of the bench. The screw acts on a paddle-like front jaw, forcing it in the direction of the front of the bench in order to capture a workpiece between the paddle-like jaw and the front of the bench.

Many vises use a clamping screw passing through the jaws and exposed within the clamping space between the jaws. This screw is often coated with lubricant to facilitate smooth operation of the vise and protect the moving parts from corrosion. Where a clamped workpiece contacts this screw, it can be contaminated by the lubricant and otherwise damaged. This is particularly troublesome in woodworking, because the lubricant can be absorbed into the workpiece, and interfere with subsequent applications of adhesives or finishes. Further, contact with the screw thread can damage the workpiece by denting the surface, which at best requires work to remove the damaged section, and at worst can render the part useless if the damaged surface has already been brought to finished dimensions.

SUMMARY OF THE INVENTION

The vises of this invention utilize a threaded screw and nut to translate rotary motion of the screw into linear relative movement of vise components.

In tail vise embodiments of this invention, placement of the tail vise mechanism outside the movable vise jaw and under the bench great simplifies installation and facilitates utilization of a more robust mechanism, since the size of the mechanism is not restricted to what can be contained within the vise jaw. The main or vise screw may be positioned in the mechanism nearest the underside and front edge of the bench to reduce racking, and racking is further resisted by one or more guide rods. Such asymmetrical arrangement of the screw and guide rods typically causes the vise assembly to be "handed," i.e., suitable for location only on one or the other end, but not both ends, of the front of a workbench. Easy reconfiguration of the vise from "right-handed" to "left-handed" or the reverse can be accomplished however by utilization of mirror image end plates that permit the vise handle and any quick-release control mechanism to be positioned on either end.

In front vise or other embodiments of this invention, the main or vise screw may be positioned generally between two guide rods in order to apply pressure at or near the center of a movable vise jaw, but such symmetrical arrangement of these components is not required, and guide rods may be unnecessary.

Use of the quick release nut mechanism of this invention provides essentially the same benefits when used in a front vise as in the tail vise embodiment of this invention, while also making it possible to position a cover over the screw to prevent contact between a workpiece and the top of that screw.

BRIEF DESCRIPTION OF THE DRAWINGS

FIG. 3 shows the half-nut disengaged from the screw, and FIG. 4 shows the half-nut held by the cam in engagement with the screw.

DETAILED DESCRIPTION

Figure 1:
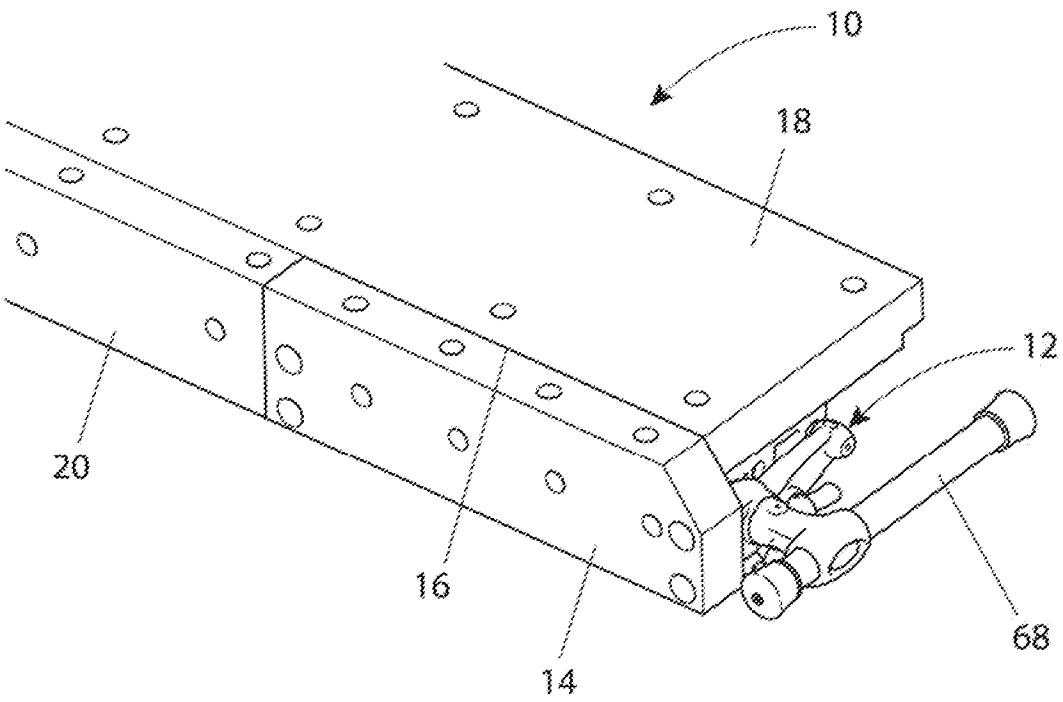
FIG. 1 is a perspective view of a portion of a bench top to which an embodiment of the vise of this invention is attached.

The vise embodiment 10 of this invention, as shown in FIG. 1, is a tail vise that utilizes a vise mechanism 12 mounted entirely behind the vise jaw 14 and under the bench 16, permitting a vise 10 to be added to a bench top 18 with the addition of only a fixed apron 20 that serves as a fixed jaw and a movable vise jaw 14 that can have the same cross-sectional shape as the apron 20. This greatly simplifies installation and permits utilization of a robust assembly, since the size of the mechanism is not restricted to what can be contained within the movable jaw 14.

Figure 2:
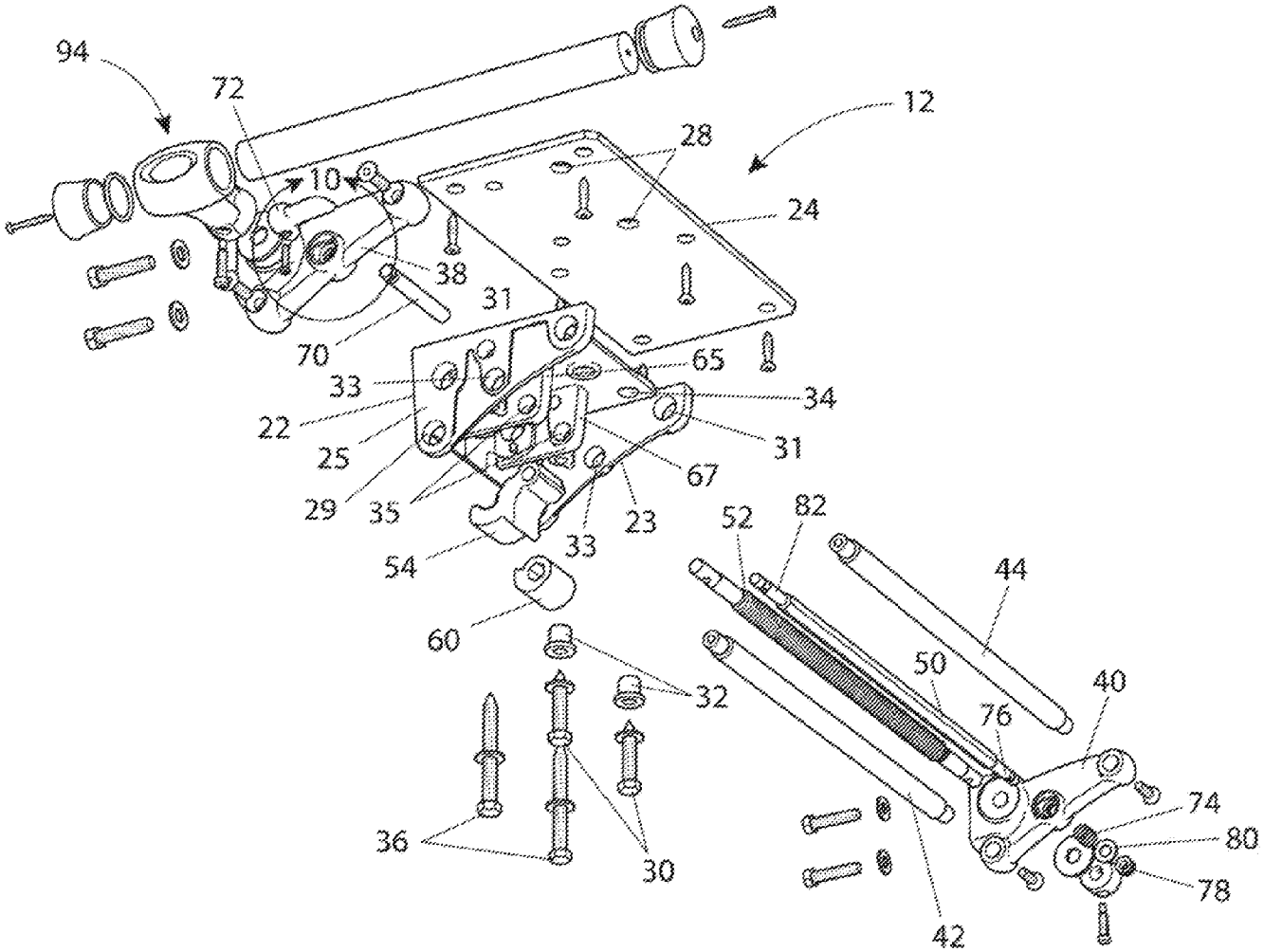
FIG. 2 is an exploded perspective view of the underside, rear and left end of the tail vise embodiment of this invention.

A fixed base casting 22 (FIG. 2) attaches to the underside of the bench top 16, either directly or by first securing a mounting plate 24 that can be easily located and mounted precisely where needed using flat-head wood screws 26. In one of many possible mounting procedures, the mounting plate 24 can then be used as a drill bushing for drilling counter bore holes (not shown) through bushing holes 28 and a short distance (e.g., about ⅛" to ¼") into the underside of the bench top 18, followed by pilot holes for lag screw 30 centered in the counter bore holes. A bushing 32 may then be driven through each base bushing hole 34 in the base 22, through each mounting plate bushing hole 34 and into the counter bore in underside of the bench top 18. A lag screw 30 passing through each bushing 32, together with lag screws 36, can securely attach the base 22 to the bench top 18. Other means for positioning or securing the vise base to the bench top could be used than the mounting plate, bushings and flat head and lag screws. For instance, the base 22 could be attached directly to the bench top 18 without use of a mounting plate. As another example, a shallow recess in the shape of the base 22 could be routed or otherwise formed in the bench top 18 to facilitate precisely locating the base 22.

Base 22 includes generally triangular, parallel base plates 23 and 25 that are penetrated by aligned holes—hole 27 for receiving screw 52; holes 29 and 31 for receiving guide rods 42 and 44; and hole 33 for receiving cam shaft 50. All of these screw, guide rods and cam shaft slide through base plates 23 and 25 during adjustment of the relative positions of vise jaws 14 and 20 when opening or closing the jaws.

With vise mechanism 12 attached to the underside of a bench top 18 near an edge of the bench 16, the jaws of the vise 10 may be provided by an apron 20 fixed to the front edge of the bench top 18 and a movable jaw 14 having a simple rectangular cross-section attached to vise mechanism 12. Jaw 14 is attached to the faces 48 of vise end plates 38 and 40. The base 22 attached to the bench top 18 is stationary, and the other vise mechanism 12 components move relative to or through the fixed base 22. The ends of one or more guide rods 42, 44, a cam shaft or nut release shaft 50, and a threaded main screw 52 are attached to and maintain the relative positions of the two generally triangular end plates 38 and 40. A movable vise jaw 14 (typically wood) attaches to side faces 46 and 48 of the end plates 38 and 40 so that the jaw 14 travels beside the fixed base 22 and extends up beside the edge of the bench top 18 and flush with its top surface, as the rods 42 and 44 and screw 52 travel through the base 22. The leading face 13 of the vise jaw 14 abuts the end 19 of an apron 20 attached to the front edge of the bench top 18 and typically extending from the top 18 the same distance as the front to back thickness of the vise jaw 14. The base also contains the "female" threaded element of the clamping screw assembly. The female threaded element may be a nut immovably attached to or captured within the base or a releasable "half-nut" 54 mechanism that can be disengaged from the screw 52 to facilitate rapid opening or closing of the vise jaws 14 and 20 with the half-nut 54 disengaged.

In the vise 10 embodiment depicted in the Figures, in order to apply the vise-closing (or vise-opening) force along a line relatively close to the location (or the effective location) of contact between the work piece and jaws 14 and 20, the main or vise screw 52 is positioned in the corner 56 of the base 22 nearest the underside and front edge of the bench top 18. This reduces racking, and racking is further resisted by one or more guide rods 42, 44 that are secured between the end plates and slide through base 22. One rod 42 is positioned generally below screw 52, and the other rod 44 is positioned at about the same level as screw 52 but behind that screw 52, remote from the jaw faces 46, 48.

Movement of jaw 14 is achieved by rotation of screw 52 with vise handle 68 with "half-nut" 54 engaging the screw. Half-nut 54 pivots on a short rod 70 captured between two stanchions 65 and 67 that protrude (or depend) from the base 22. The half nut 54 is raised into engagement with the screw 52 by a nut cam 60 also captured between stanchions 65 and 67 and that slides along (but cannot rotate on) a nut release shaft 50. Shaft 50 is controlled to rotate back and forth a fraction of a revolution by a release lever 72 on one end of the nut release shaft 50. Nut release shaft 50 passes through and freely rotates within holes 35 in stanchions 65 and 67.

Figure 4:
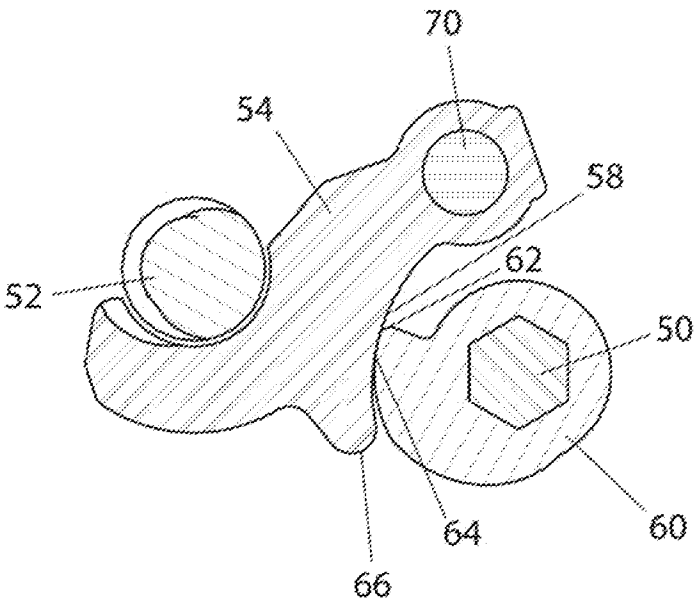
FIGS. 3 and 4 are enlarged fragmentary end views of the half-nut and cam of the embodiment of this invention shown in FIG. 2, together with cross sections of the screw and cam shaft.
Figure 3:
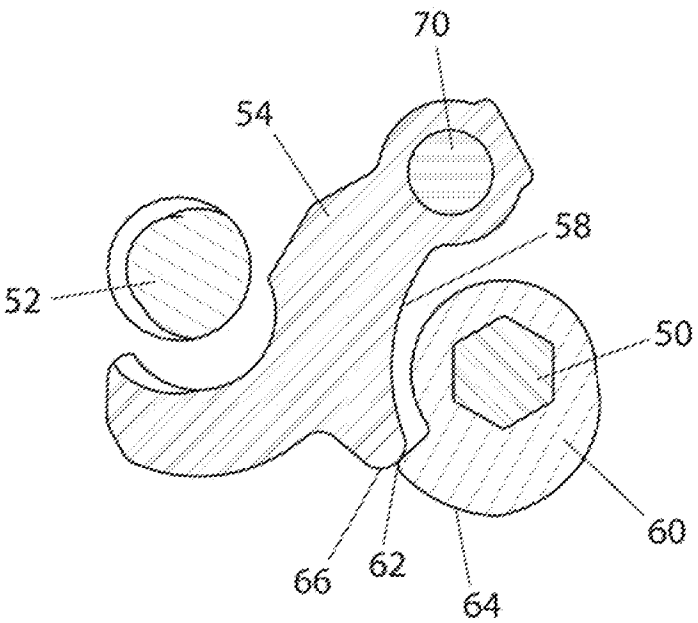
Figure 5:
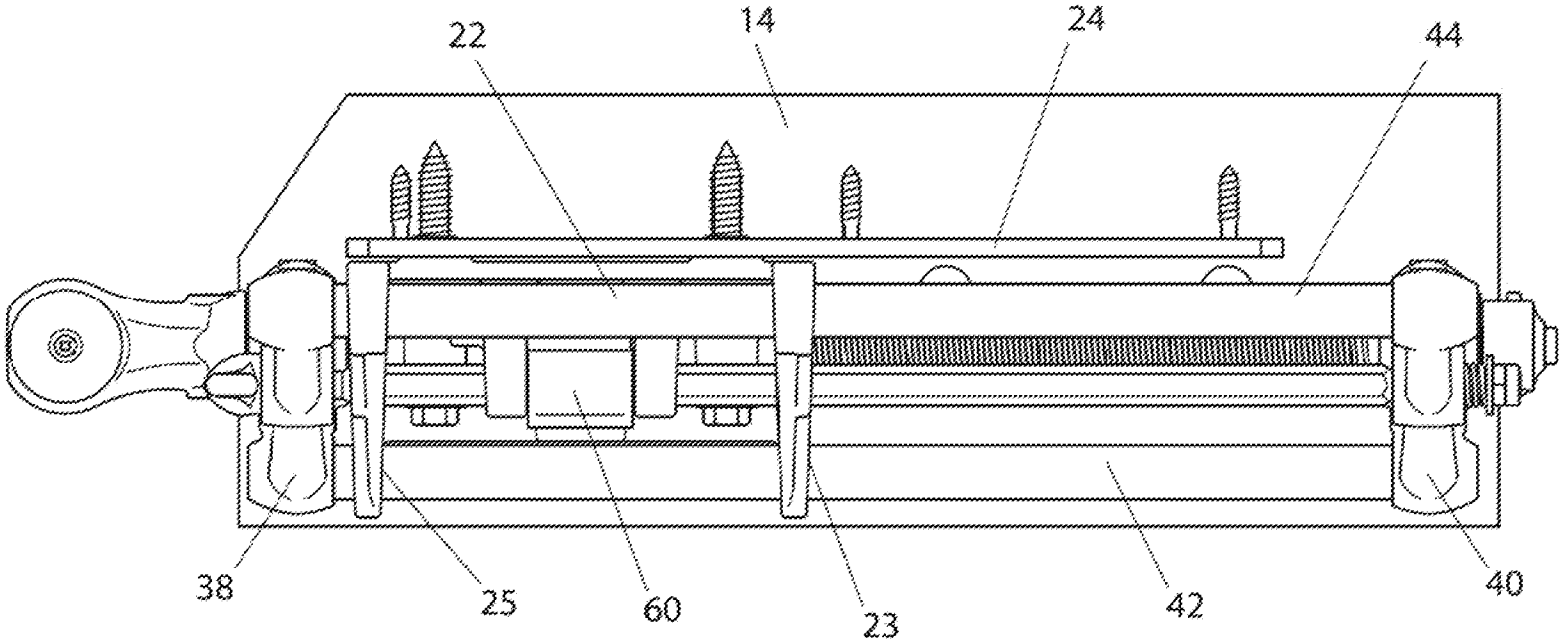
FIG. 5 is a rear view of the vise depicted in FIG. 2, shown with a movable vise jaw attached.
Figure 6:
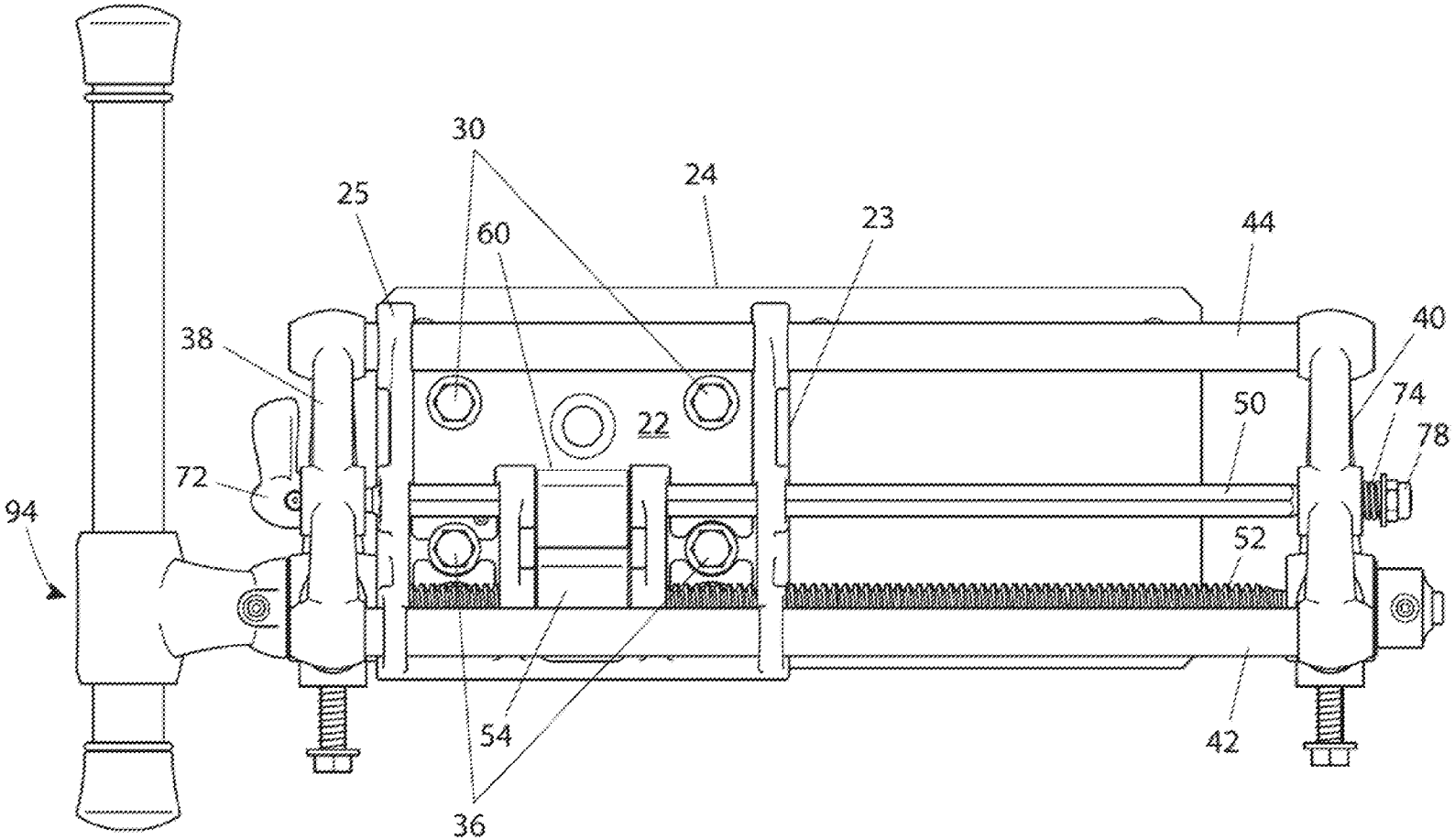
FIG. 6 is a bottom view of the vise depicted in FIG. 2.
Figure 7:
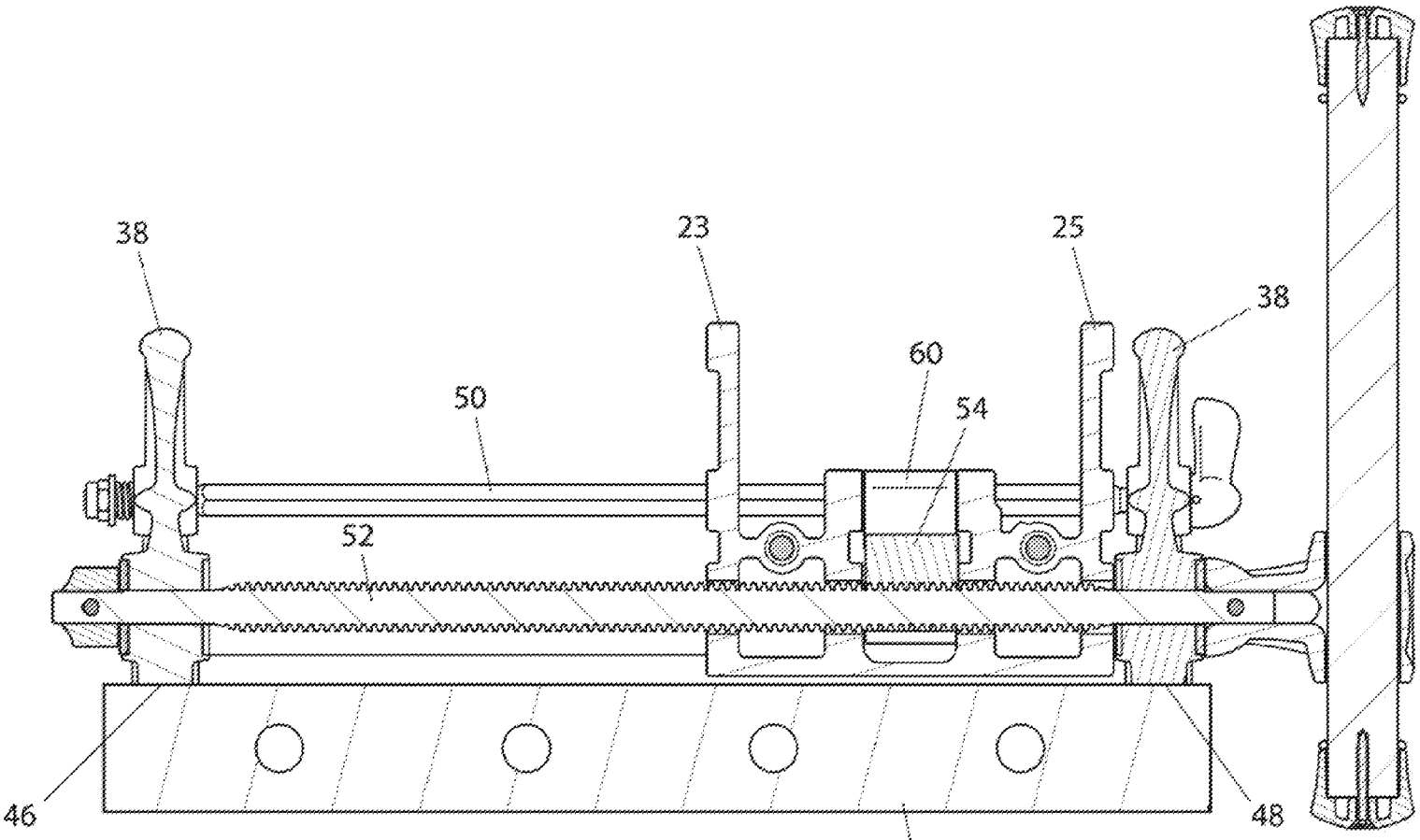
FIG. 7 is a section view taken at A-A in FIG. 5.
Figure 9:
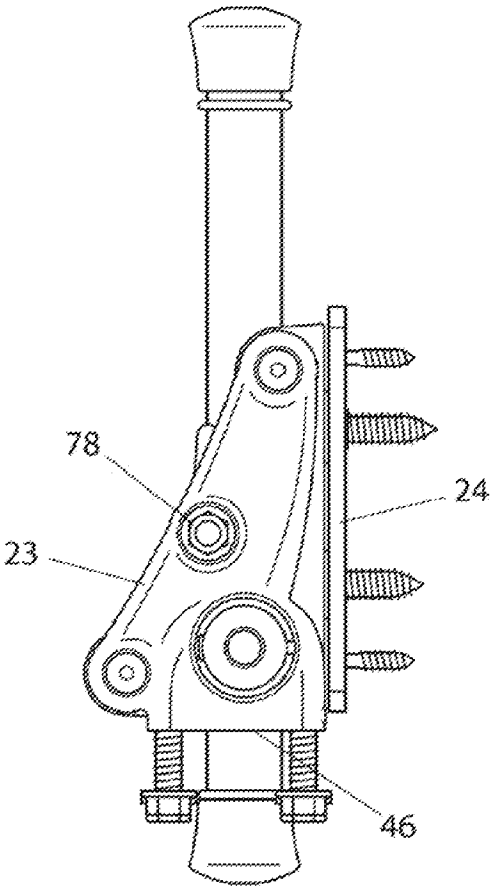
FIG. 9 is the end remote from the handle of the vise depicted in FIG. 2.
Figure 8:
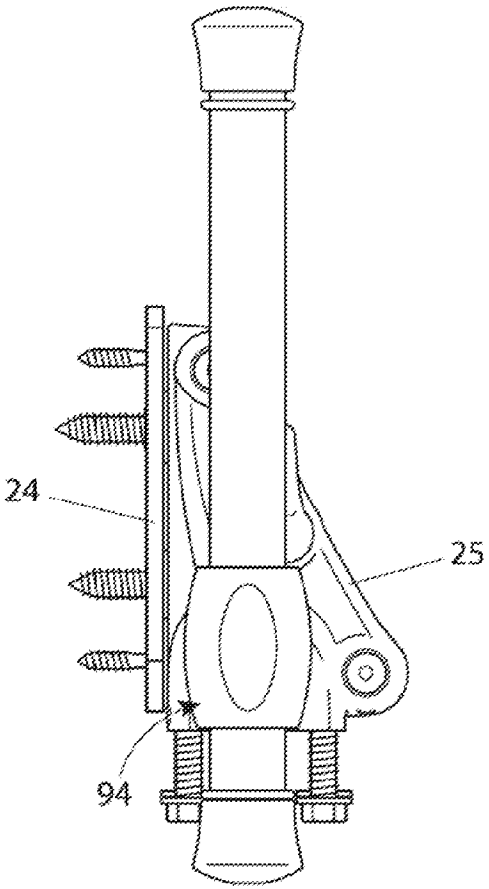
FIG. 8 is the handle end of the vise depicted in FIG. 2.

Nut release shaft 50 can have a hexagonal cross section as may be seen in FIGS. 3 and 4, to match a hexagonal opening in cam 60. The shaft 50 shape could also be square, octagonal or virtually any other non-round shape with a correspondingly shaped opening in cam 60, provided that the cam and shaft geometries permit good rotational coupling between cam 60 and shaft 50 while permitting cam 60 to slide freely along shaft 50. Furthermore, among other possible alternatives, a round shaft 50 cross section could be used with a keyway in the shaft and structure on the cam 60 to engage that keyway.

As may be appreciated by comparing FIGS. 3 and 4, cam 60 is rotatable between a first position shown in FIG. 3 permitting half-nut 54 to pivot down out of engagement with screw 52, and a second position shown in FIG. 4 engaging screw 52 to which position rotation of cam 60 lifts half-nut 54. Level 72 rotates nut release shaft 50, after cam lift portion 62 of cam 60 lifts half nut 54 beginning with contact with half-nut protruding heel 66. As cam portion 62 moved beyond heel 66, contact between cam surface 64 and half-nut contact surface 58 (as shown in FIG. 4) maintains half-nut 54 in engagement with screw 52. This over-center geometry helps to maintain half-nut 54 in engagement with screw 52 without undesirably forcing the half-nut 54 against the screw 52 and without binding as screw 52 is rotated and cam 60 travels along cam shaft 50. Moreover, with this geometry and contact, maintenance of cam 60 in an exact rotational position is not required. This robust, "forgiving" structure is particularly important in vises subjected to significant forces over a very long period of time will little lubrication or maintenance in a relative "hostile" environment with potentially large temperature excursions and copious quantities of wood dust and other foreign materials.

In both embodiments of this invention depicted in the Figures (including the front vise embodiment 110 described in detail below), gravity pivots half-nut 54, 154 out of engagement with screw 52, 152 when shaft 50, 150 rotates cam 60, 160 out of engagement with half-nut 54, 154. Half-nut 54, 154 could also be pivoted out of engagement by a coiled, leaf or other spring, among other structures, which would enable different location of half-nut 54, 154 around screw 52, 152. Among yet other alternatives, half-nut 54, 154 could be urged into engagement with screw 52, 152 by a spring or its own weight (for instance with the half-nut positioned above screw 52, 152), and cam 60, 160 or another lift or other structure could be used to force half-nut 54, 154 out of engagement with screw 50, 150.

Figure 10:
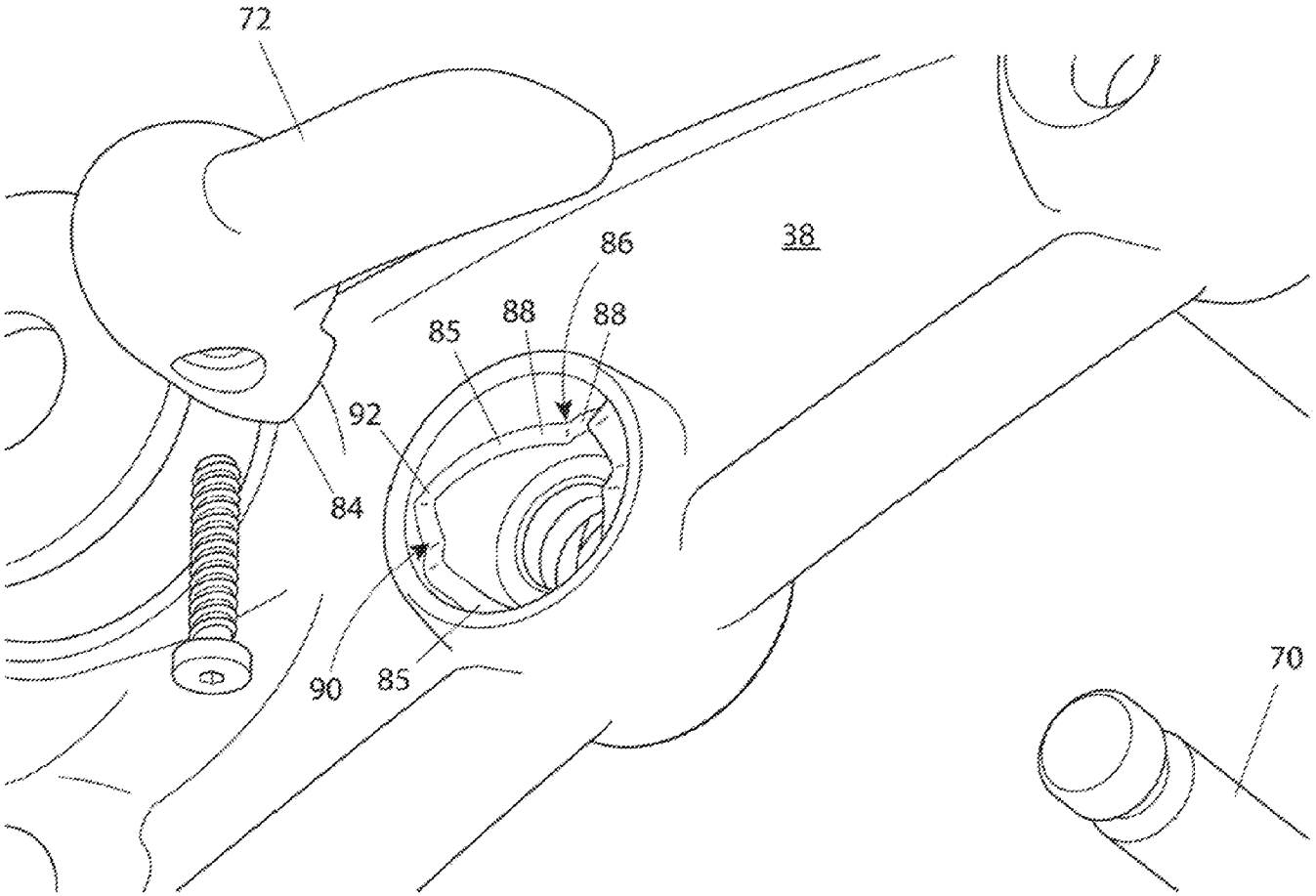
FIG. 10 is an enlarged fragmentary view taken from FIG. 2, showing the lever, nut release shaft and end plate.
Figure 11:
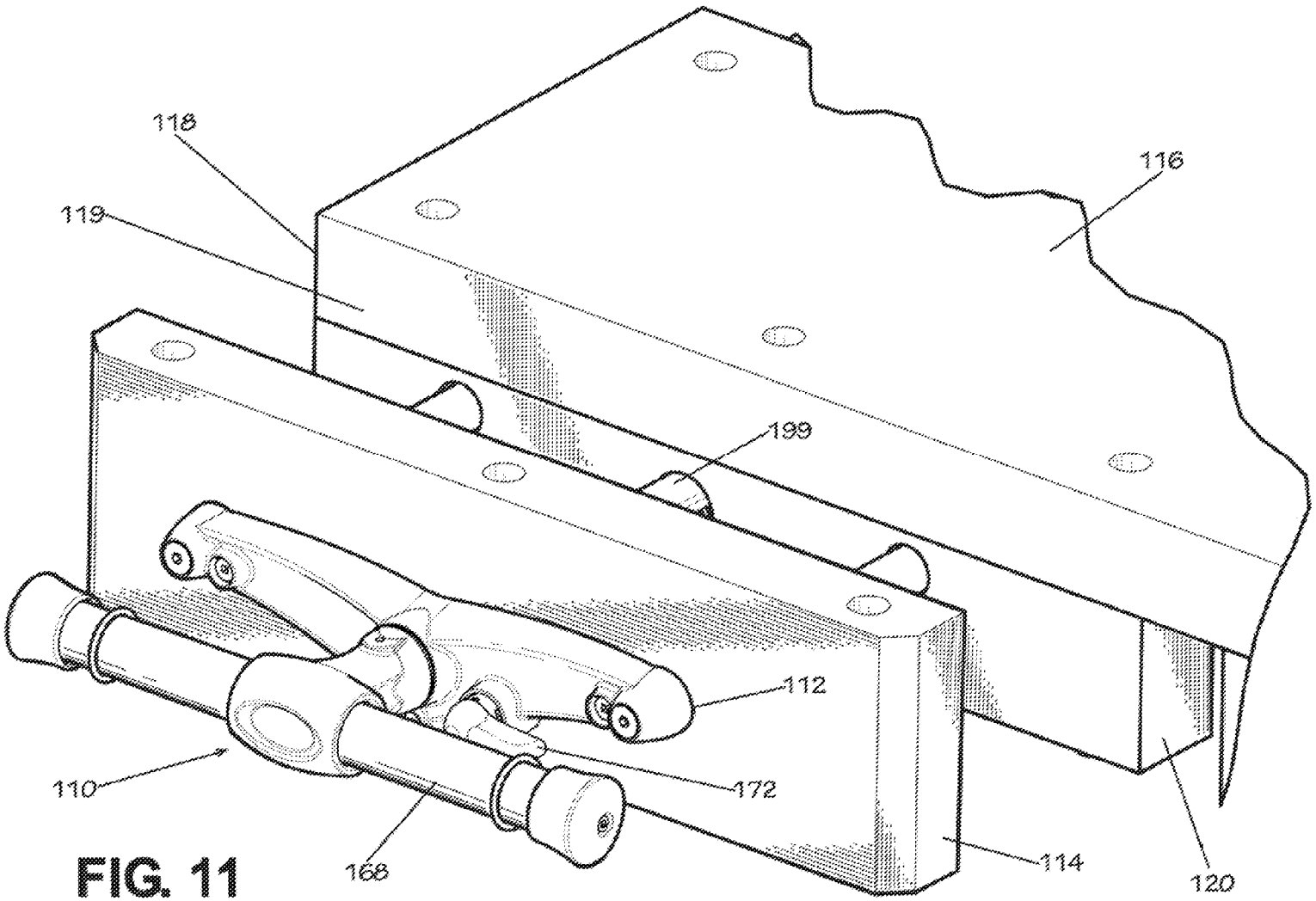
FIG. 11 is a perspective view of a portion of a bench top to which a second, front vise embodiment of the vise of this invention is attached.

Cam 60 can be pivoted between two stable positions, one with half-nut 54 disengaged (FIG. 3) and the other with it engaged with screw 52 (FIG. 4). Such functionality can be achieved with a structure with cam shaft 70 axially loaded by a coiled spring 74 positioned around the remote end 76 of shaft 50 between end plate 40 and a locking or other nut 78 and washer 80 on the end 76 of the shaft 50. Spring 74 draws the lever 72 fixed to the lever end 82 of the shaft 50 firmly against the end plate 38 lever seating structure against which the lever 72 seats. As may be seen in FIG. 10, lever 72 has two opposed wedge-shaped protrusions 84 one of which is visible in FIG. 10. Protrusions 84 are beside shaft end 82 when the lever 72 is attached to the shaft 50. These protrusions 84 seat in either: (1) valleys 86 formed between ramp 85 lower ends 88 or (2) detents 90 formed where the ramp 85 upper ends 92 converge. Thus, interaction between the lever protrusions 84 and the ramps 85 and detents 90 in end plate 38 cause shaft 50 to remain in one of two positions until sufficient rotational force is exerted on lever 72 to move shaft 50 axially so that protrusions 84 move from the valleys 86 to the detents 90 or the reverse. The net effect is that the spring 74 helps rotate the cam 60 into full engagement with the half-nut 54, unless the lever 72 is turned to the fully disengaged position, where the detents 90 hold it in position. The valleys 86 and detents 90 can be located at any desired positions relative to each other that provide sufficient shaft 50 rotation to successfully drive cam 60 to its desired positions, while permitting ramps 85 to interact appropriately with protrusions 84. Lever 72 and shaft 50 rotation in the mechanism 12 depicted in the Figures is somewhat more than 90 degrees. Numerous other structures or mechanisms for securing shaft 50 alternatively in two desired rotational positions can also be used.

With half-nut 54 disengaged from screw, vise jaw 14 and the attached vise components can be slid rapidly toward or away from the apron 20 by exerting force on the jaw 14, handle 68 or other movable structure in the desired direction. Lever 72 may then be rotated to engage half-nut 54 with screw 52, after which the handle 68 may be rotated to close or open the jaw 14.

The mechanism 12 depicted in the Figures is a "right-handed" tail vise configured for positioning at the right front of a workbench. As depicted, however, with "mirror-image" end plates 38 and 40, the same components can be easily reconfigured into a "left-handed" tail vise by reversing the end of screw 54 to which handle assembly 94 is attached and reversing the ends of nut release shaft 50 to which (a) lever 72 and (b) spring 74, nut 78 and washer 80 are attached. End plates 38 and 40 are "mirror image" components in that each of their sides is a mirror image of the opposite side of the other. Moreover, both such mirror image plates 38 and 40 can be manufactured from the same casting by forming castings with mirror-image structures, such as the ramps 85 and detents 90 described above, and with bosses that can be machined to form both of the needed structures at a particular location, depending on which end plate is produced.

The front vise embodiment 110 of this invention, depicted in FIGS. 10-18, utilizes a vise mechanism 112 mounted under the bench 116, permitting a front vise 110 to be added to a bench top 118 with the addition of only a rear jaw 120 that serves, together with the front edge 119 of the bench top 118, as a fixed jaw and a movable vise jaw 114. This greatly simplifies installation.

A fixed base casting 122 (FIG. 12) attaches to the underside of the bench top 118 using lag wood screws 126 and 136 or other suitable fasteners.

In one of many possible mounting procedures, the base 122 can be used as a drill bushing for drilling counter bore holes (not shown) through bushing holes 128 and a short distance (e.g., about ⅛" to ¼") into the underside of the bench top 118, followed by pilot holes for lag screw 126 centered in the counter bore holes. A bushing 132 may then be driven through each base bushing hole 128 in the base 122 and into the counter bore in underside of the bench top 118. A lag screw 126 passing through each bushing 32, together with lag screws 136, can securely attach the base 122 to the bench top 118. Other means for positioning or securing the vise base to the bench top could be used than the bushings and lag screws. For instance, the base 122 could be attached to the bench top 118 without use of bushings 132. As another example, a shallow recess in the shape of the base 122 could be routed or otherwise formed in the bench top 118 to facilitate precisely locating the base 122.

Base 122 includes elongated, parallel base plates 123 and 125 that are penetrated by aligned holes: hole 127 for receiving screw 152; holes 129 and 131 for receiving guide rods 142 and 144; and hole 133 for receiving cam shaft 150. All of these screw, guide rods and cam shaft slide through base plates 123 and 125 during adjustment of the relative positions of vise jaws 114 and 20 when opening or closing the jaws.

With vise mechanism 112 attached to the underside of a bench top 118 near an edge 119 of the bench 116, the jaws of the vise 110 may be provided by (1) the edge 119 and a rear jaw 120 and (2) a movable, front jaw 114 attached to vise mechanism 112. Front jaw 114 is attached to the rear face 148 of front plate 138. The base 122 attached to the bench top 118 is stationary, and the other vise mechanism 112 components move relative to or through the fixed base 122. The ends of one or more guide rods 142, 144, a cam shaft or nut release shaft 150, and a threaded main screw 152 are attached to and maintain the relative positions of the two elongated end plates 138 and 140. The movable front jaw 114 (typically wood) attached to front plate 138 travels relative to the fixed base 122 and extends up beside the front edge 119 of the bench top 118 and flush with the top surface of bench top 118, as the rods 142 and 144 and screw 152 travel through the base 122.

The base 122 also contains the "female" threaded element of the clamping screw assembly. The female threaded element may be a nut immovably attached to or captured within the base or a releasable "half-nut" 154 mechanism that can be disengaged from the screw 152 to facilitate rapid opening or closing of the vise jaws 114 and 120 with the half-nut 154 disengaged. Among many other alternatives, this half-nut 154 mechanism may be functionally identical to the half-nut 54 mechanism associated with the first, end vise embodiment 12 of this invention described above and depicted in FIGS. 1-10.

In the second, front vise embodiment 112 of this invention depicted in FIGS. 11-18, the screw 152 is generally centered in the front plate 138 to reduce racking, and racking is further resisted by one or more guide rods 142, 144 equally distant from screw 152, generally on each side of screw 152.

Movement of jaw 114 when clamping a workpiece between the jaws 114 and 119/120, or to exert a separating force, is achieved by rotation of screw 152 with vise handle 168 with "half-nut" 154 engaging the screw. Half-nut 154 pivots on a short rod 170 captured between two stanchions 165 and 167 that protrude (or depend) from the base 122. The half nut 154 is raised into engagement with the screw 152 by a nut cam 160 also captured between stanchions 165 and 167 and that slides along (but cannot rotate on) a nut release shaft 150. Shaft 150 is controlled to rotate back and forth a fraction of a revolution by a release lever 172 on one end of the nut release shaft 150. Nut release shaft 150 passes through and freely rotates within holes 133 in base 122.

Figure 12:
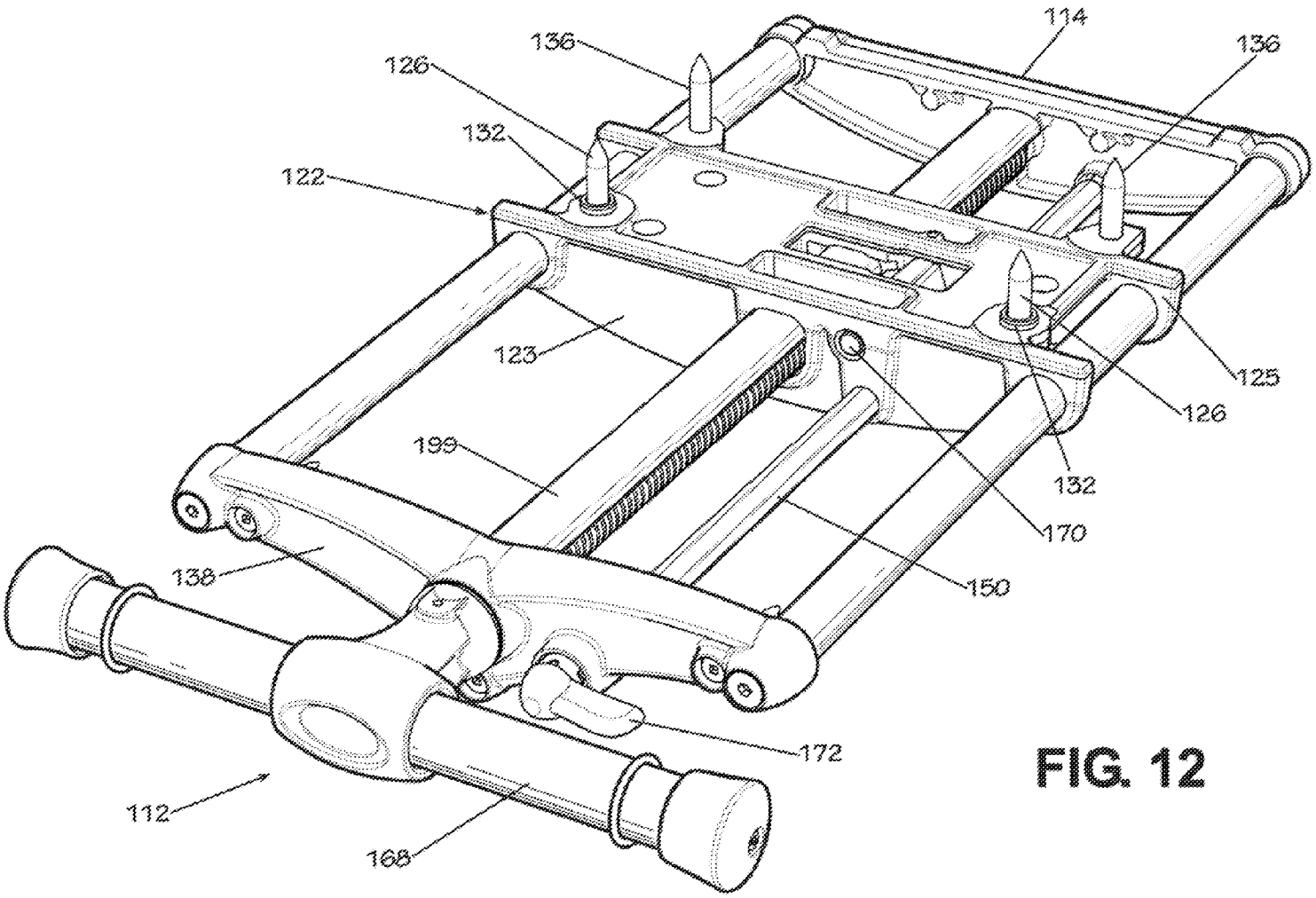
FIG. 12 is a view of the front vise embodiment of this invention similar to FIG. 11, but without any bench or wood jaw components.
Figure 13:
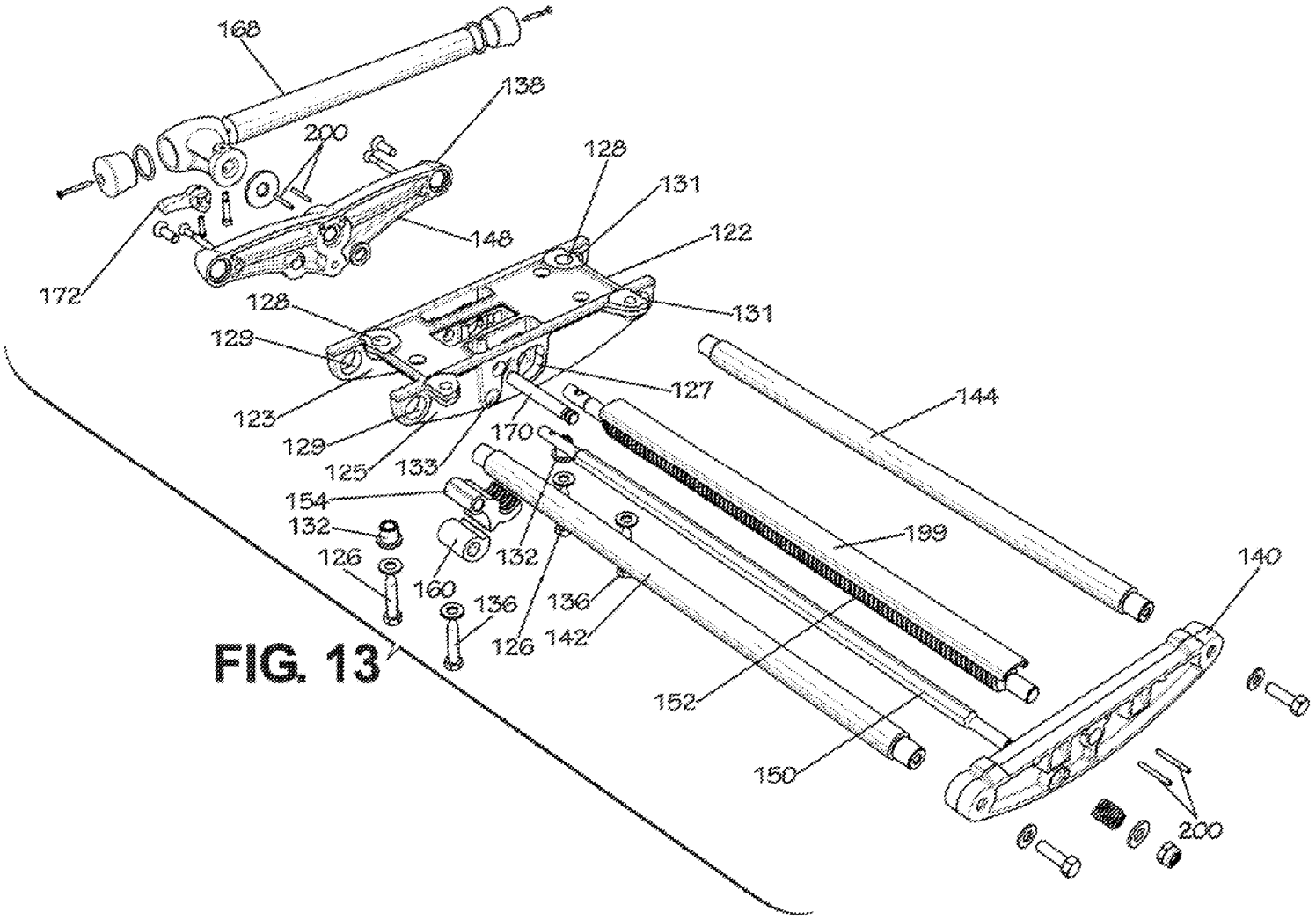
FIG. 13 is an exploded perspective view of the top side, right side and rear end of the front vise embodiment shown in FIGS. 11 and 12.
Figure 14:
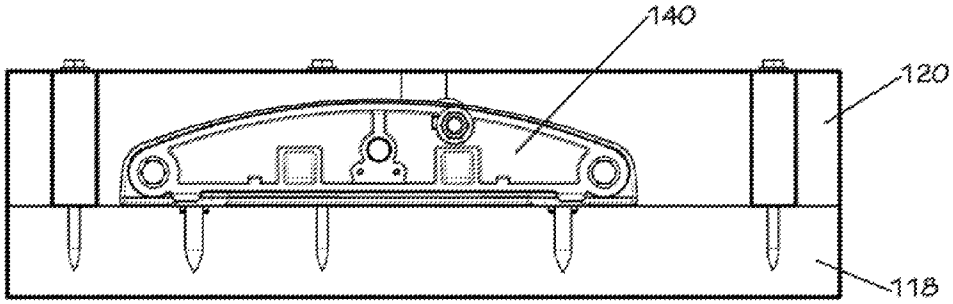
FIG. 14 is a rear view of the vise depicted in FIGS. 11 and 12, shown with a rear jaw and front jaw attached.
Figure 15:
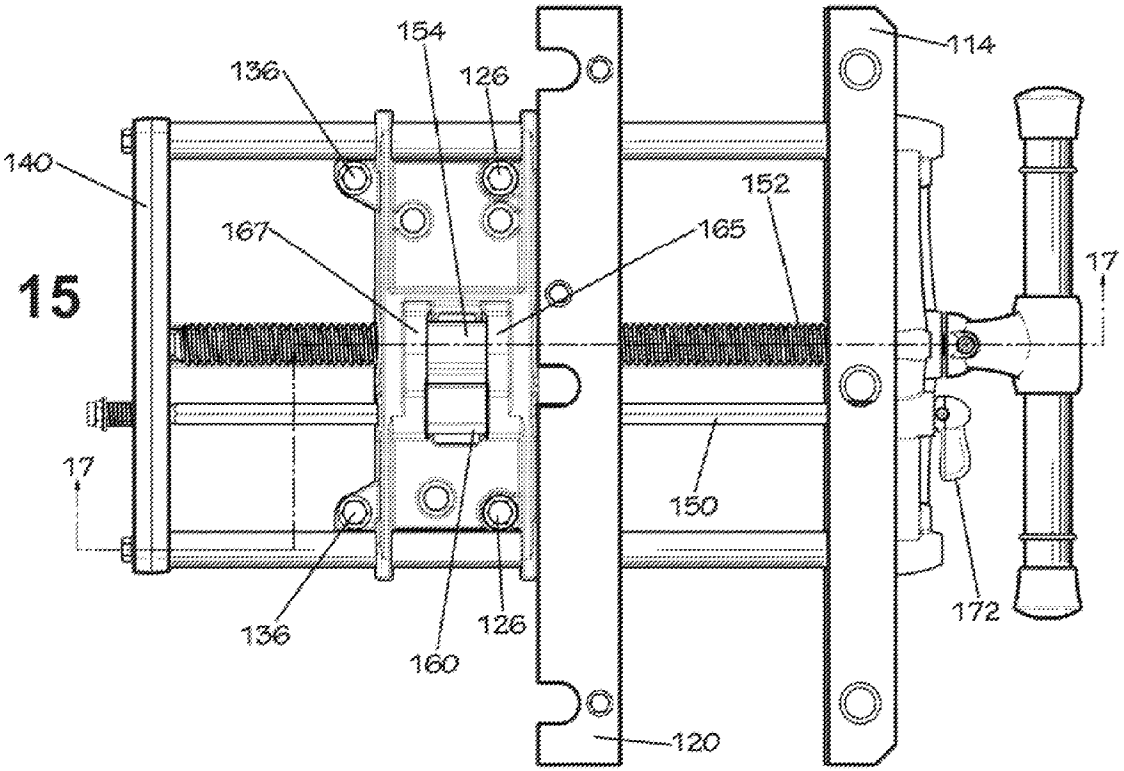
FIG. 15 is a bottom view of the vise depicted in FIGS. 11 and 12, shown with a rear jaw and front jaw attached.
Figure 16:
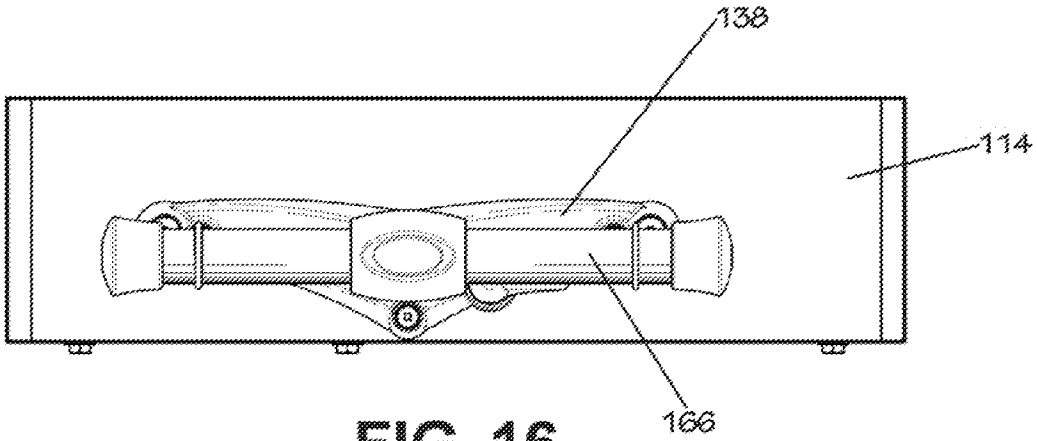
FIG. 16 is a front view of the vise depicted in FIGS. 11 and 12, shown with a rear jaw and front jaw attached.
Figure 17:
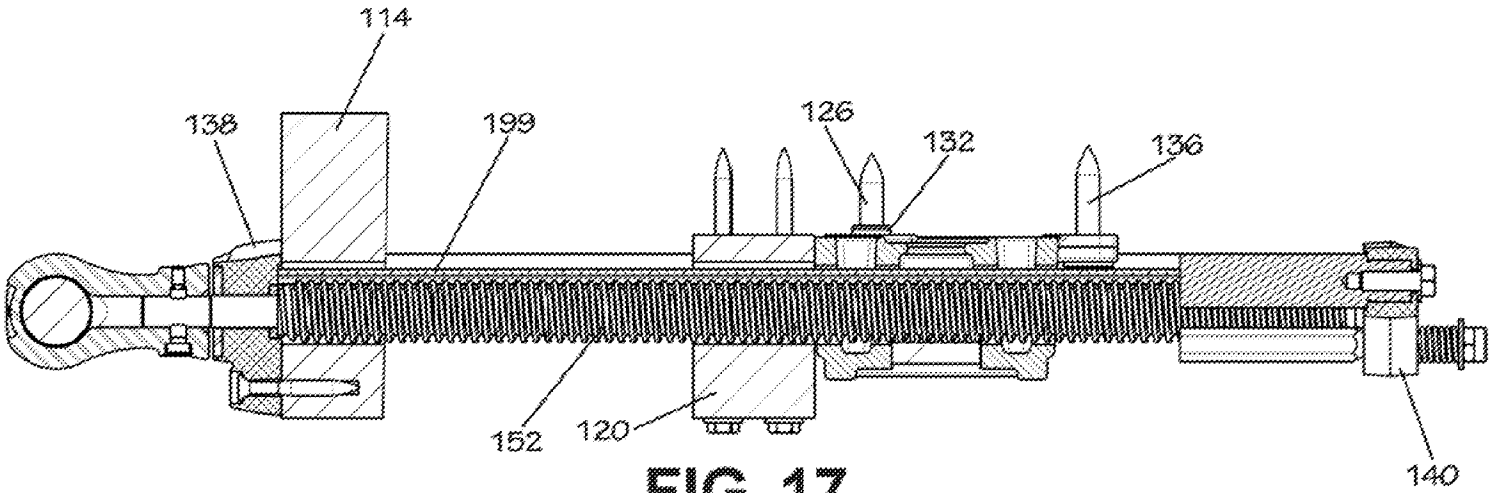
FIG. 17 is a section view taken at line 17-17 in FIG. 15.
Figure 18:
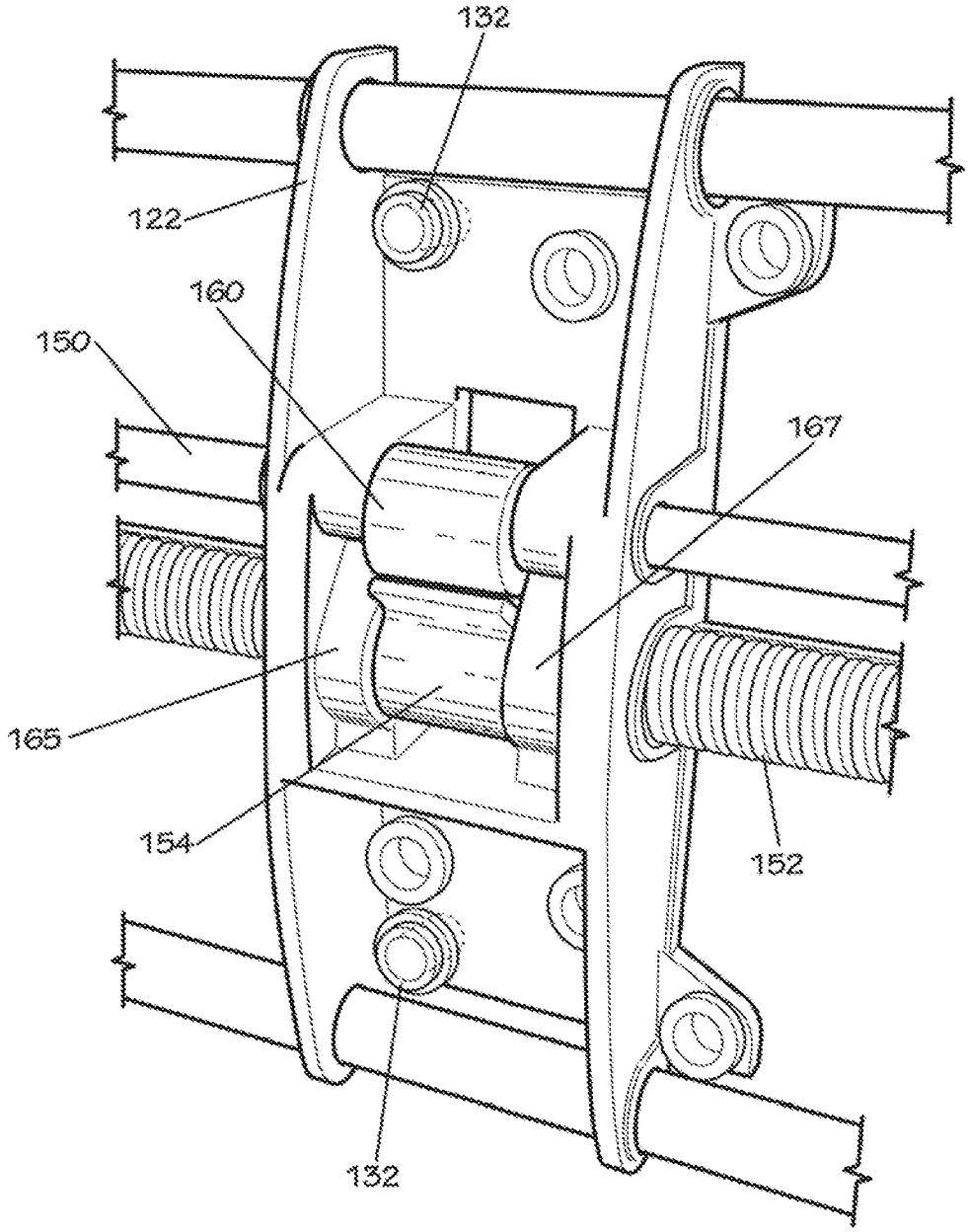
FIG. 18 is a perspective view of a portion of the underside of the vise depicted in FIGS. 11 and 12.

Nut release shaft 150 can have a hexagonal cross section as may be seen in FIGS. 12, 13 and 15, to match a hexagonal opening in cam 160. As is described above, the shaft 150 shape could also be square, octagonal or virtually any other non-round shape with a correspondingly shaped opening in cam 160, provided that the cam and shaft geometries permit good rotational coupling between cam 160 and shaft 150 while permitting cam 160 to slide freely along shaft 150. Furthermore, among other possible alternatives, a round shaft 150 cross section could be used with a keyway in the shaft and structure on the cam 160 to engage that keyway.

Engagement and disengagement of half-nut 154 may function in the same way depicted in FIGS. 3 and 4 and as is set forth above in the description of the tail vise embodiment 10 of this invention, particularly including (among other places) the description of FIGS. 3 and 4. Among other alternatives, control of such engagement and disengagement of half-nut 154 may be accomplished in front vise embodiment 112 with lever 172 and associated structure in front plate 138 the same as lever 72 (with protrusions 84) and associated structure in plate 38 (front plate 38 elements 85, 86, 88, 92) of the tail vise embodiment 12 of this invention described above and depicted in FIGS. 1-10, particularly including FIG. 10.

With half-nut 154 disengaged from screw 152, vise jaw 114 and the attached vise components can be slid rapidly toward or away from the bench top 118 by exerting force on the jaw 114 or other structure in the desired direction. Lever 172 may then be rotated to engage half-nut 154 with screw 152, after which the handle 168 may be rotated to close or open the jaws 114 and 119/120.

A screw cover 199 (FIGS. 11, 12, 13 and 17) protects workpieces from contact with the screw 152. Screw cover 199 may be received in appropriate recesses in front plate 138 and back plate 140 or otherwise secured to and captured between those plates 138 and 140. As can be appreciated by reference to FIG. 13, each end of screw cover 199 can be secured to one of plates 138 or 140 with one or more pins 200 that pass through one of plates 138 or 140 and into an end of screw cover 199. Alternatively, screw cover 199 may be attached to only one of front plate 138 or back plate 140, and cover 199 need not be the full length of screw 152 since it need only cover the portion of the screw 152 accessible between the vise 110 jaws 114 and 119/120 when those jaws are fully open. Pins 200 can be spring pins or one or more threaded screws or other fasteners for securing screw cover 199 to one or both plates 138 and 140. Screw cover 199 travels through the base 122 together with the screw 152 and as plates 138 and 140 move. Cover 199 can cover even the part of screw 152 engaging half-nut 154 because half-nut 154 contacts only the underside of the screw 152. If a different nut configuration were used, the shape, attachment and configuration of screw cover 199 might need to be appropriately modified.

Cover 199 can be an aluminum extrusion. It could also be plastic, formed steel (or other metal) or any other appropriately strong, stiff and protective material.

End plates 138 and 140 can be elongated structures having an outer profile of a triangle only modestly "deeper" near the middle of the plates than their ends. As depicted in the Figures, plates 138 and 140 can be metal castings with reinforcing webs and appropriate bosses reinforcing regions where rods or the screw are attached to or pass through the plates. As can be appreciated by comparison of FIGS. 14 and 16, plate 138 need not be identical to plate 140, although they could be at least cast in essentially identical or mirror image forms. End plates 138 and 140 could also be formed of other materials, including metals, metal alloys, plastics and reinforced plastics, and in other ways, including, for instance, machining from metal bar or plate stock. A machined plate might have a simpler structure than the plates 138 and 140 depicted in the Figures. For instance, such machined plates might not including ribs or bosses.

In addition to the embodiments depicted in the Figures and described in detail above, the vises of this invention can be produced in a variety of different configurations adapted for a variety of different types of benches or other structures. Moreover, the vises of this invention can be made in numerous different sizes, depending on the desired application, in a number of different configuration, and from numerous suitable alternative materials.

The vises of this invention can be produced from a number of different materials, including steel, aluminum and a wide range of alloys, as well as wood and plastics for the handle, jaws and other components.

While the depicted embodiments of the vises of this invention utilize two end plates or a front and a back plate, a configuration that uses only one end plate is also possible, providing that adequate overall stiffness and resistance to racking can be achieved.

The vise configurations of this invention include not only woodworking tail and front vises but numerous other general and special purpose vises, clamps, jigs, fixtures and similar devices that utilize a drive screw to achieve forcefully applied linear motion and pressure.

Similarly, while the depicted embodiments use two guide rods that are round shafts, fewer or more guide rods can be used, and they can have different cross-sections.

The tail vise embodiment 10 mounting plate 24 depicted in some of the Figures and described above provides a mechanism for precisely locating the vise base 22 when attaching it to the underside of a bench by first positioning and securing an accurately machined flat steel plate 24 to the bench underside and then attaching the base 22 to the plate 24 using bushings to achieve precise location of the vise mechanism 12 relative to the bench.

Other locating means than those described above can be used, and plate 24 can be omitted. Other means of relative positioning of base 22 and plate 24 in vise 10 could use pins, ribs, ridges or other projections in one of the base 22 and plate 24 received in holes, grooves, depressions or the like in the other of the plate 24 and base 22.

A plate like plate 24 can also be used for mounting front vise mechanism 112, but exact location of mechanism 112 on bench 116 is not as critical as may be location of sliding tail vise mechanism 12. Accordingly, use of a locating mounting plate may not be as important, and mechanism 112 can be mounted without a plate.

Screw 52, 152 and half-nut 54, 154 may have a variety of thread types or geometries, including Acme threads, but the thread type used should accommodate force applied axially in either direction, so that both clamping and separating pressure can be exerted using the mechanism 12, 112. The thread geometry also preferably should not result in significant force urging the half-nut 54, 154 to disengage when the screw 52, 152 is rotated, because this may increase the likelihood that the threaded components will bind or jam during use.

All of the above-described embodiments, modifications, variations, as well as variations not explicitly described above are intended to be within the scope and spirit of the following claims.

The invention claimed is:

1. A "quick-release" woodworking vise mechanism for attachment to an underside of a workbench top having a top side and for use with a wooden first jaw having an upper edge generally co-planer with the top side of the workbench top and a wooden second jaw or workbench structure, comprising:

a. a screw coupled to the wooden first jaw for urging the first jaw toward or away from the wooden second jaw or workbench structure by rotating the screw with a handle, b. a half-nut coupled to the second jaw through a base attachable to the workbench top underside and pivotable, by manipulation of a control located proximate the handle, between:

i. a position engaging the screw and causing the wooden first jaw to be moved relative to the wooden second jaw or workbench structure by rotation of the screw, and ii. a position disengaged from the screw and permitting movement of the wooden first jaw without rotation of the screw;

wherein the base comprises a pair of parallel plates each having a first aperture receiving the screw, a second and third aperture receiving a first and second guide rod, and a fourth aperture receiving a shaft.

2. The vise mechanism of claim 1, wherein:

a. the screw has two ends and is coupled to the first jaw by attachment of each of the screw ends to one of two plates, one of which plates attached to the first jaw, and b. the second jaw is coupled to the half-nut by capture of the half-nut in the base configured for attachment to the underside of the workbench top so the first jaw can project upward alongside an edge of the workbench.

3. The vise mechanism of claim 1, wherein the control comprises:

a lever attached to the shaft and a cam positioned to slide freely along the shaft and rotate with the lever and shaft: i. in one direction to contact and move the half-nut into engagement with the screw and ii. in the opposite direction to lower and disengage the half-nut from the screw.

4. The vise mechanism of claim 1, further comprising two end plates, one of which is rotatably attached to a first end of the screw and the other of which plates is rotatably attached to the other end of the screw.

5. The vise mechanism of claim 4, wherein each of the end plates is adapted for attachment to the same first vise jaw.

6. The vise mechanism of claim 5, wherein the adaptation for attachment to the same first jaw comprises an end plate side face parallel to a longitudinal axis of the screw and to which side faces one vise jaw may be attached with wood or machine screws, bolts or other fasteners.

7. The vise mechanism of claim 6, wherein the base is configured for attachment to the underside of the workbench top so a jaw attached to the side faces can project upward and travel alongside an edge of the workbench top.

8. The vise mechanism of claim 3, wherein the shaft is axially loaded by a coiled compression spring to draw at least one protrusion from the lever into contact with structure in an end plate through which the shaft passes so that: a. the lever will be maintained in a first rotational position with the protrusion seated in a first recess or detent unless significant rotational force is exerted on the lever to move the at least one protrusion from the first recess or detent, after which b. contact between the at least one protrusion and a ramp structure in the end plate causes the lever and shaft to rotate to another rotational position and remain there unless significant rotation force is exerted on the lever.

9. The vise mechanism of claim 1, wherein:

a. the screw has two ends and is coupled to the first jaw by attachment of one of the screw ends to a plate attached to the first jaw, and b. the second jaw is coupled to the half-nut by capture of the half-nut in the base configured for attachment to the underside of the workbench top that forms or is attached to the second jaw.

* * * * *